United States Patent [19]

Theurer et al.

[11] 4,284,009

[45] Aug. 18, 1981

[54] MOTORIZED RAILWAY VEHICLE TRACK WORKING MACHINE AND METHOD OF OPERATION

[75] Inventors: Josef Theurer, Vienna; Karl Fölser, Linz-Urfahr, both of Austria

[73] Assignee: Franz Plasser Bahnbaumaschinen Industriegesellschaft m.b.H., Vienna, Austria

[21] Appl. No.: 39,880

[22] Filed: May 17, 1979

[30] Foreign Application Priority Data

Jul. 19, 1978 [AT] Austria ..... 5248/78

[51] Int. Cl.[3] ..... B61B 15/14; B61F 13/00; E01B 27/04

[52] U.S. Cl. ..... 104/7 R; 37/104; 104/12; 105/215 R

[58] Field of Search ..... 104/7 A, 7 B, 7 R, 1 R, 104/12; 105/215 C, 215 R; 37/104; 280/664

[56] References Cited

U.S. PATENT DOCUMENTS

| | | | |
|---|---|---|---|
| 2,016,626 | 10/1935 | Constantinesco | 105/215 R |
| 3,249,067 | 5/1966 | Keller | 105/215 C |
| 3,494,300 | 2/1970 | Anderson et al. | 104/12 |
| 3,581,671 | 6/1971 | Hart | 105/215 C |
| 3,690,262 | 9/1972 | Plasser et al. | 104/7 R |
| 3,808,693 | 5/1974 | Plasser et al. | 105/215 R X |
| 3,850,251 | 11/1974 | Plasser et al. | 37/104 X |
| 4,094,251 | 6/1978 | Theurer | 104/7 R X |

FOREIGN PATENT DOCUMENTS

| | | | |
|---|---|---|---|
| 1122966 | 8/1968 | United Kingdom | 280/664 |

*Primary Examiner*—Joseph F. Peters, Jr.
*Assistant Examiner*—Howard Beltran
*Attorney, Agent, or Firm*—Kurt Kelman

[57] ABSTRACT

A self-propelled track working machine comprises a frame, track working equipment carried by the frame and subjecting the frame to a load and an undercarriage arrangement with two main undercarriages supporting the frame for mobility on the track and an auxiliary undercarriage associated with each main undercarriage and arranged adjacent thereto. The main undercarriages include driven axles to propel the machine and each auxiliary undercarriage includes a dead axle with two wheels arranged to engage the track rails and an adjustment drive for moving the auxiliary undercarriage for selective engagement of the wheels of the dead axle with the track rails whereby diminishing or increasing portions of the load are transmitted to the track by the dead axles and wheels of the auxiliary undercarriages in dependence of the movement of the auxiliary undercarriages into the selected engagement and the load transmitted by the associated main undercarriages is correspondingly increased or diminished by operation of a control for the adjustment drives.

8 Claims, 5 Drawing Figures

MOTORIZED RAILWAY VEHICLE TRACK WORKING MACHINE AND METHOD OF OPERATION

The present invention relates to a self-propelled track working machine, especially a ballast cleaning machine and a method of operating the machine. The machine comprises a frame, track working equipment carried by the frame and subjecting the frame to a load, and an undercarriage arrangement comprising a plurality of main undercarriages supporting the frame for mobility on the track. Each main undercarriage includes at least one driven axle with two wheels engaging the track rails to propel the machine and the load being transmitted from the frame to the track by the axles and wheels of the main undercarriages.

Various problems are encountered in the development and operation of track working machines, including those posed by the permissible loads to which track components may safely be subjected. The mounting of different track working equipment on a common machine frame causes different forces to be transmitted to the frame and thence to the track during operation of the equipment, requiring special construction of the undercarriages which support the machine frame on the track. Additional difficulties are caused by the need to provide auxiliary structures enabling the machine to travel at relatively high speeds between working sites, either self-propelled or coupled to a train, if the undercarriages are to have the most favorable construction for use at the working site during operation of the equipment.

U.S. Pat. No. 3,690,262, dated Sept. 12, 1972, discloses a track tamping, leveling and lining machine comprising a plurality of undercarriages spaced along the frame in the direction of the frame elongation for adaptation to various working or track conditions. To adapt to these conditions, at least one of the undercarriages may be temporarily disengaged from the track. In this manner, the wheelbase, i.e. the distance between the machine-supporting undercarriages, may be changed in accordance with the prevailing operating conditions. Thus, the wheelbase is lengthened during leveling and lining of the track with a track correction unit mounted between the front and rear axles to reduce stress on the track rails due to bending while it is shortened when the machine is moved from working site to working site at higher speeds to obtain a higher stability of the machine during such high-speed travel and to enable it to take curves better. Machines of this structure have been very successful in track maintenance work. The load of the frame and the operating equipment it carries is transmitted to the track by the two supporting undercarriages in accordance with their selected distance from each other.

It is the primary object of this invention to provide a track working machine of the first-described type which makes it possible to meet all track load requirements even in a very heavy machine while also enabling the machine to travel at relatively high speeds.

This and other objects are accomplished in such a machine according to the invention with an undercarriage associated with and arranged adjacent each main undercarriage, each auxiliary undercarriage including a dead axle with two wheels arranged to engage the track rails. An adjustment drive is connected to each auxiliary undercarriage for moving the auxiliary undercarriage for selective engagement of the wheels of the dead axle with the track whereby diminishing or increasing portions of the load are transmitted by the wheels of the dead axle to the track in dependence of the movement of the auxiliary undercarriages into the selected engagement and the load transmitted by the associated main undercarriages is correspondingly increased or diminished. A control for each adjustment drive for selective actuation thereof effectuates the selective engagement. When the load on the main undercarriage with its driven axle or axles is increased, traction is correspondingly enhanced during the operation of the track working equipment at the working site when the machine advances in low-speed drive.

According to another aspect of the present invention, the machine is operated by propelling it selectively in high-speed drive and low-speed drive, adjusting each auxiliary undercarriage for moving the auxiliary undercarriage for selective engagement of the wheels of the dead axle with the track rails in dependence on the drive, and controlling the adjustment movement so as to effectuate the engagement in high-speed drive to transmit portions of the load to the track by the dead axles and correspondingly to decrease the load transmitted to the track by the main undercarriages while effectuating disengagement in low-speed drive and correspondingly to transmit the entire load to the track by the main undercarriages whereby the traction is increased. Preferably, the engagement is so controlled as to vary the portions of the load transmitted by the dead axles to hold the load transmitted by the main undercarriages to a predetermined level.

In this manner, the track working machine may be very simply and effectively adapted to the respective needs prevailing during operation and travel of the machine. By selectively distributing and changing the loads transmitted by the undercarriages to the track, the machine is readily and rapidly adapted to permissible load conditions dependent either on the track construction or the machine operation or speed. These adaptations correspondingly change the traction. By reducing the load on the dead axle during operation of the track working equipment when the machine advances in low-speed drive the load on the adjacent main undercarriage is correspondingly increased, which automatically enhances the traction which is a product of the load on the driven axle and the friction modulus between rails and wheels. On the other hand, when the load on the dead axle is increased at the end of the track working operation by engaging the wheels of the dead axle with the track rails, the load on the adjacent main undercarriage is relieved, the traction is correspondingly reduced and the track rails are subjected to smaller forces during the travel of the machine along open track in high-speed drive, thus reducing wear of the track rails. Furthermore, a machine with such an undercarriage arrangement can be used on tracks with different load characteristics, such as main and branch lines, since the loads transmitted to the track may be readily controlled by the selective engagement of the movable auxiliary undercarriages with the track rails.

The undercarriage arrangement of the present invention has the additional advantage that the use of main undercarriages, such as swivel trucks, with three or more axles instead of two or three axles may be avoided under conditions in which the total load to be transmitted to the track does not substantially exceed the sum of the permissible loads on each axle of the machine. In this manner, more space becomes available for track working equipment mounted between the undercarriages since swivel trucks with only two axles provide a greater distance between the pivots of the trucks as well as a smaller distance between the axles of each truck. This leaves an increased space between the undercarriages for mounting track working equipment on frames of equal length. At the same time, use of swivel trucks with two axles makes it possible to shorten the distance of the truck pivots from the respective ends of the machine frame, thus enabling the machine to take sharp curves without any machine part projecting laterally beyond the track into the path of an adjacent track, for example. It should be noted in this respect that wheelbases and axle distances on swivel trucks with two and three axles cannot be arbitrarily changed but must comply with official requirements which are based on permissible loads on bridges and the like.

The above and other objects, advantages and features of this invention will become more apparent from the following detailed description of certain now preferred embodiments thereof, taken in conjunction with the accompanying schematic drawing wherein FIG. 1 is a side elevational view of a ballast cleaning machine incorporating the undercarriage arrangement of the invention, showing the machine during operation;

Figure 4:
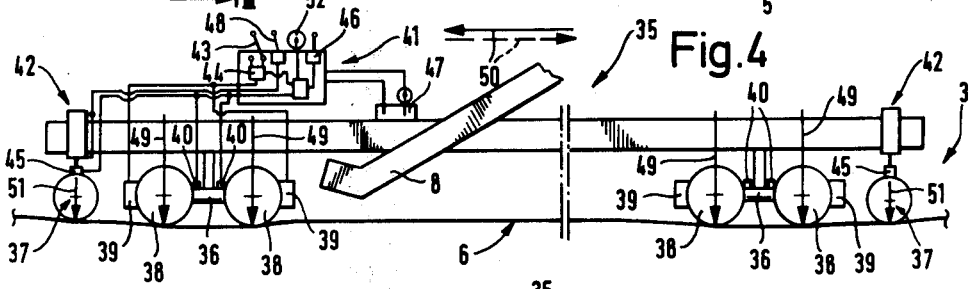
Figure 5:
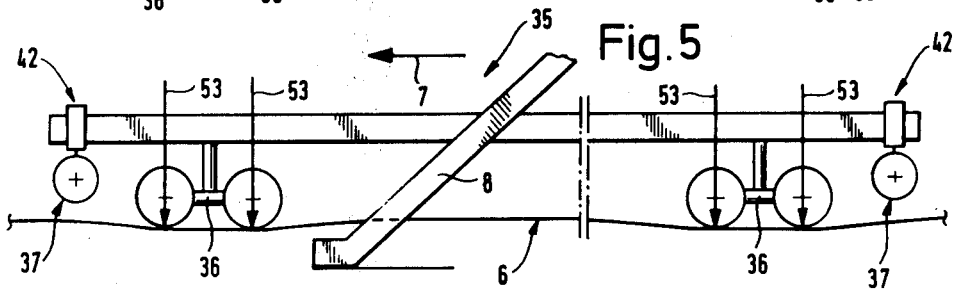

FIG. 4 is a diagrammatic showing of the axle load distribution in a track working machine wherein the dead axles have been lowered for load transmission, the varying level of the track rail caused by the axle loads being illustrated with exaggeration for a better understanding; and FIG. 5 is a similar diagrammatic showing of a different axle load distribution, the dead axles having been raised into a rest position.

Figure 1:
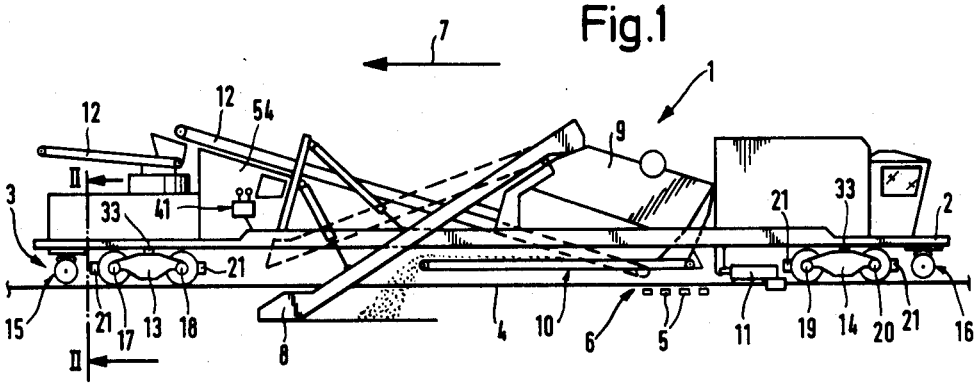

Referring now to the drawing and first to FIG. 1, illustrated track working machine 1 is a ballast cleaning machine comprising frame 2 and track working equipment carried by the frame and subjecting the frame to a load, the illustrated equipment including ballast excavation and conveying chain 8 of a generally conventional type, screen arrangement 9 receiving the excavated ballast from the chain, distributing conveyor arrangement 10 receiving the cleaned ballast from the screen arrangement and distributing it over the excavated railroad bed, and plow arrangement 11 for smoothing the redistributed cleaned ballast. Waste separated from the ballast in screen arrangement 9 is removed by conveyor arrangement 12, all of this working equipment being well known and forming no part of the present invention.

An undercarriage arrangement 3 comprising a plurality of undercarriages 13, 14, 15 and 16 supports frame 2 for mobility on track 6 comprised of rails 4 fastened to ties 5. The machine moves along the track in an operating direction indicated by arrow 7.

A track working machine of this type is quite heavy, considering the massive frame required to carry the working equipment and the massive working equipment itself, and becomes even heavier during operation when the working equipment carries considerable loads of ballast. During operation, machine 1 advances along the working site at a relatively low speed. When the machine has finished operation at a working site and is to be moved to another site, ballast excavating chain 8 is lifted into a rest position shown in broken lines, as is plow 11, and the machine is propelled at speeds up to about 80–100 km/h, during which high-speed travel the track is subjected not only to the heavy axle loads and also to considerable dynamic forces generated by the vibrations which are imparted to the machine.

To sustain these forces, undercarriage arrangement 3 comprises two main undercarriages constituted by swivel trucks 13 and 14 each having two axles, and two auxiliary undercarriages 15 and 16 each including a dead axle with two wheels 23, 24 arranged to engage track rails 4, the auxiliary undercarriages being associated with the swivel trucks and being adjacent thereto. Each axle 17, 18, 19 and 20 of the swivel trucks is driven to propel the machine, drive 21 being connected to each swivel truck axle and being operable in a low-speed and high-speed drive mode. In the operating position of machine 1 illustrated in FIG. 1, auxiliary undercarriages 15 and 16 are in their rest position in which they do not transmit any load to the track so that the entire load is transmitted to the track by swivel trucks 13 and 14 with their driven axles. This produces considerable traction when the machine advances in low-speed drive in the direction of arrow 7, thus enabling the machine to overcome even heavy resistance to its forward drive due, for example, to heavily encrusted ballast and to distribute and smooth the cleaned ballast properly by operation of plow 11. During operation of the machine, its load is supported exclusively by driven axles 17, 18, 19 and 20 to produce the desired traction which is the product of the axle load and the friction between the wheels and the rails. The traction can be varied simply by changing the axle load if the friction is assumed to be constant.

Figure 2:
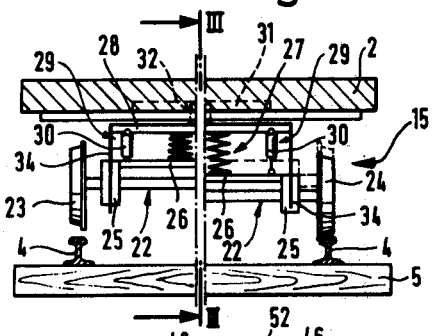
FIG. 2 is a section along line II—II of FIG. 1, showing a front view of a vertically adjustable dead axle of the undercarriage arrangement, one half on the figure illustrating the wheel in load-transmitting engagement with the associated track rail while the other half of the figure illustrates the axle in raised position.
Figure 3:
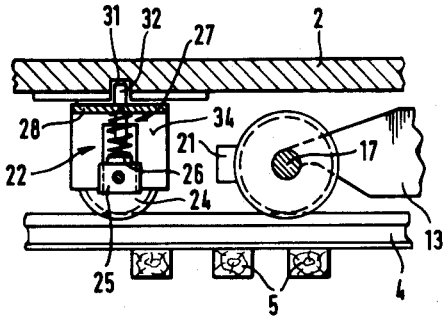
FIG. 3 is a section along line III—III of FIG. 2.

As shown in FIGS. 2 and 3, adjustment drive 29 is connected to auxiliary undercarriages 15 and 16 for moving the undercarriages for selective engagement of wheels 23 and 24 of dead axle 22 with the track, left wheel 23 being shown disengaged from its associated rail 4 while right wheel 24 is illustrated in engagement with the associated track rail. In this manner, the portion of the load transmitted by wheels 23, 24 of dead axles 22 to the track can be diminished or increased and the load transmitted by the associated undercarriages 13 and 14 is correspondingly increased or diminished.

In the illustrated embodiment, spring means 27 consisting of a compression spring is mounted to transmit the portion of the load to each dead axle 22 and thence to track 6 and abutment plate 28 supports one end of the spring means, the abutment plate being mounted on frame 2 transversely glidably substantially in a direction radial to the center point of an adjacent driven axle 17, and adjustment drive 29 is linked respectively to the dead axle and the abutment plate. The adjustment drive is comprised of two hydraulic motors 30 arranged to lift the dead axle against the bias of spring means 27 vertically into a rest position out of engagement with the track and in a direction substantially parallel to the path of the spring means bias. Bearing means 25 is mounted on dead axle 22 between wheels 23 and 24 for rotatably supporting the wheels on the dead axle, and each bearing 25 carries plate 26 for supporting an end of compression spring 27 opposite to the one end supported by abutment plate 28. The spring is held between plates 26 and 28 in a center region of the dead axle, and hydraulic motors 30 of adjustment drive 29 are connected to the dead axle in the region of bearings 25. The abutment plate includes stop means 34 for delimiting the movement of bearings 25 and dead axle 22 relative to the abutment plate. The illustrated stop means is constituted by plates 34 projecting from abutment plate 28 downwardly towards track 6 in the region of bearings 25. The stop plates have recesses receiving the bearings, thus preventing axle 22 with wheels 23, 24 from being displace either in the longitudinal direction of frame 2 or transversely thereto, the bearings having abutments cooperating with the recesses.

As shown in FIG. 3, machine frame 2 defines transverse guideway 31 in the underside thereof for guiding guide pin 32 projecting from abutment plate 28 into engagement with the guideway. Guideway 31 runs transversely to the longitudinal direction of frame 2 and in a direction radial to center point 33 of the associated main undercarriage 13, 14, the swivel axis of the undercarriage running through the center point. This assures a trouble-free run of dead axle 22 in curves.

As will be appreciated from a consideration of the two halves of FIG. 2, spring 27 is compressed when motors 30 are actuated to lift axle 22 into its rest position parallel to the path of bias of the spring. When lowered, on the other hand, axle 22 will transmit a portion of the load of machine 1 to track 6. The spring characteristic of spring 27 is so selected that the spring will transmit that portion of the load of the machine to wheels 23, 24 which exceeds the load predetermined to be transmitted by driven axles 17, 18, 19 and 20. It would also be possible to vary the portion of the load transmitted by dead axles 22 by suitably selecting the stroke or pressure of hydraulic adjustment motors 30, this pressure producing the differential load portion between a predetermined desired load on the driven axles and an actually measured load thereon. This adjustment of the loads transmitted by the dead and driven axles, respectively, makes it possible to vary the respective loads constantly during operation and travel of the machine to take into account all track conditions and always to obtain the most favorable load distribution over all the axles.

The illustrated arrangement of swivel trucks with two driven axles and movable auxiliary undercarriages associated with the swivel trucks and arranged adjacent thereto at the sides of the swivel trucks facing away from each other, with adjustment drives for linearly or pivotally raising the auxiliary undercarriages into a rest position, has the advantage of eliminating the need for swivel trucks with three axles frequently required for very heavy track working machines. It also reduces costs and simplifies the construction. Mounting the dead axles adjustably for selective displacement into a rest position makes it possible to use the mass of the dead axles additionally to load the driven axles, thus enabling the traction to be increased during the operation of the machine when such an increase is desirable to overcome resistance to the advancement of the machine under difficult operating conditions. During operation, the forward speed of the machine is minimal so that no dynamic forces are transmitted from the machine to the track, which makes it possible to increase the permissible axle loads.

The illustrated spring and adjustment drive arrangements for the dead axles provide a compact structure and assure a relatively quiet run in curves even at high speeds, due to the radial guidance of the dead axles relative to the center point of the adjacent undercarriage. Displacing the dead axles parallel to the path of the spring bias for moving the dead axles into their rest positions provides a particularly simple structure and avoids the need for additional guides. The above-described preferred embodiment of the centered spring mounting and holding the dead axle against displacement in a longitudinal and transverse direction assures a uniform distribution of the load over both wheels of the dead axle, and the entire structure is compact and makes it possible to hold the width of the movable undercarriage to a minimum.

The diagrammatic showings of FIGS. 4 and 5 illustrate track working machine 35 respectively in the travel condition (FIG. 4), wherein track working equipment 8 is in its raised rest position above track 6, and in the operating condition (FIG. 5) when ballast excavating chain 8 is immersed in the ballast below track 6. Undercarrige arrangement 3 of machine 35 is comprised of two swivel trucks 36 each having two axles 38 driven by drives 39 and single-axle undercarriages 37 associated with and adjacent swivel trucks 36.

Adjustment drives 42 for moving auxiliary undercarriages 37 for selective engagement of their wheels with the track are illustrated as hydraulic motors and control 41 for the adjustment drive selectively actuates the drive to effectuate the selective engagement in accordance with this invention. In the illustrated embodiment, load gauges 40 are arranged to measure the loads on driven axles 38, such gauges being constituted, for example, by strain gauges mounted on the swivel trucks or the driven axles and generating output signals commensurate with the measured loads. In a manner to be described more fully hereinafter, drive 39 for driven axles 38 as well as load gauges 40 are connected to control 41 for adjustment drive 42. Drives 39 are adjustable between different drive modes including a drive mode for moving the machine 35 along track 6 between working sites in high-speed drive and another drive mode for moving the machine along the track at a working site in low-speed drive while working equipment 8 is in operation.

Illustrated control 41 shown in FIG. 4 comprises a first control element 43 for switching drives 39 between the two drive modes, i.e. between a high and low forward speed. The power connection between control element 43 and drives 39 includes means 44 arranged in series with the control element for stopping the drives. Further load gauge 45 similar to gauge 40 is arranged to measure the load on undercarriage 37 and the output signals of gauges 40 and 45 are transmitted to a comparator element where the measured axle loads are compared with a desired axle load value pre-selected by adjustment member 46. Hydraulic fluid is supplied to adjustment drive 42 from sump 47 and control element 48 is arranged in the fluid supply circuit to control actuation of the adjustment drive.

As shown in FIGS. 4 and 5, the axle load distribution differs during travel of the machine over open track (FIG. 4) and during operation of the machine on a working site (FIG. 5), adjustment drives 42 being actuated to lower auxiliary undercarriages 37 onto track 6 during travel for transmitting a portion of the load to the track while these undercarriages are in the raised rest position during machine operation when all the load is transmitted by undercarriages 36. In the travel condition on high-speed drive, axle load 49 on driven axles 38 corresponds to the highest permissible axle load, for example 20 tons, the static loads produced by the weight of the machine resting on the driven axles being supplemented by dynamic forces generated during the high-speed forward movement of the machine in either direction indicated by arrows 50. Axle load 51 on dead axles 37 is adjusted by operation of control element 48, which controls the delivery of hydraulic fluid to adjustment drive 42, so that loads 49 do not exceed the permissible limit. In other words, axles 37 takes up any load in excess of the permissible load on axles 38. This load control may be automatic if control element 48 is responsive not only to an adjustment of drives 39 between the drive modes for actuating adjustment drive 42 but also is responsive to the prevailing axle loads measured by load gauges 40 and 45 as compared to the desired axle loads adjusted by element 46. The load control may also be manually operated in response to the measured loads on axles 38 indicated on instrument 52 connected to load gauges 40.

As diagrammatically indicated, the smaller axle load 51 will transmit less force to track 6 and will, therefore, depress the track somewhat less than the load in the region of driven axles 38, axle loads 49 being sufficient to generate the traction required for the forward movement of the machine at high speeds since only a relatively small rolling resistance need to be overcome.

Referring now to FIG. 5, when the machine has arrived at a working site and operation is to be started, control element 43 is actuated to switch from high-speed drive to low-speed drive, i.e. to throw the transmission into slow forward speed. Means 44 for stopping drives 39 is mounted in the power line connected to the drives to avoid forward movement of the machine in either drive mode as long as the desired axle load distribution has not been obtained. This drive stopping means will cut off power supply to the drives and thus stop the drives if the axle loads required for the respective drive mode either exceed the set limits or are lower than these limits.

This preferred arrangement avoids damage to any track component due to overloads since the axle loads will be automatically distributed according to the preset requirements. Full safety will be achieved with the automatic drive stop since any faulty operation of the adjustment drives for the auxiliary undercarriages will be immediately detected and the machine will be stopped before any damage is done to the track or the machine is derailed.

Control 41 may be operated to supply varying pressures to adjustment drives 42 so that the load on auxiliary axles 37 may be varied according to requirements during the forward movement of machine 35, thus correspondingly adjusting the loads on driven axles 38 in accordance with the forward speed. In this manner, the permissible stress on the track due to the combined static and dynamic forces transmitted thereto will never be exceeded.

When the operation begins at the working site, control element 48 is actuated to raise undercarriages 37 so that the entire mass of the machine, for example 100 tons, rests on driven axles 38 which transmit the load to the track, thus increasing load 53 on the driven axles, for example to 25 tons. This causes a somewhat increased flexure of the track rails under axles 38 but this can readily be tolerated in view of the very slow forward speed of the machine during operation and the absence of any dynamic forces which exert stress on the track during high-speed travel. As desired, this substantial increase in the axle load bring about a corresponding increase in the traction of machine 35, which enables the machine to overcome any resistance encountered to the forward movement of the machine, such as caused by encrusted ballast, for example, or large amounts of ballast deposited in front of plow 11. In other types of track working machines, strong pushing forces are required for the operation of certain working equipment, such as ballast shaping tools, excavators, ballast plows and rail replacement mechanisms.

Control 41 has been illustrated for one undercarriage and its associated auxiliary undercarriage only but it will be obvious to those skilled in the art that it may readily be arranged for simultaneously controlling adjustment drives 42 for both auxiliary axles 37 associated with swivel trucks 36 so that the axle loads may be monitored simultaneously for both swivel trucks and may be varied in dependence on each other automatically or manually. It is also possible to relieve the auxiliary axles by actuation of control element 48 according to the desired loads in the range of the driven axles by transmitting the weight of the auxiliary axles partially or fully to track rails 4.

Control 41 is mounted in a central operator's cab 54 (see FIG. 1) in the illustrated embodiment. While the machine has been illustrated as a ballast cleaning machine, the invention may be usefully applied to other track working machines, such as track tamping, leveling and lining machines, ballast plows and the like.

In connection with dead axles 22 shown in FIG. 1, control 41 may simply be provided with a control element for moving the axles between a rest position and holding it in the rest position, and for lowering the axles into a track engaging position. Such a control element may also be associated with a drive stop means which stops the forward drive unless the dead axles are in the desired adjusted position. Operation of control 41 coupled to adjustment drive 29 will also change the spring characteristic of spring 27 on operation of the adjustment drive so that the preset load determined by the spring characteristic is changed accordingly.

What is claimed is:

1. A heavy self-propelled track working machine comprising a frame, track working equipment carried by the frame and subjecting the frame to a load, and an undercarriage arrangement which comprises a plurality of main undercarriages supporting the frame for mobility on the track, each main undercarriage being constituted by a swivel truck having two driven axles each having two wheels engaging the track rails to propel the machine, the load being transmitted from the frame to the track by the axles and wheels of the main undercarriages, an auxiliary undercarriage associated with each main undercarriage and arranged adjacent thereto, each auxiliary undercarriage including a dead axle with two wheels arranged to engage the track rails under a selected pressure, an adjustment drive connected to each auxiliary undercarriage for moving the auxiliary undercarriage for engagement of the wheels of the dead axle with the track rails under the selected pressure whereby diminishing and increasing variations of the load are transmitted to the track by the dead axles and wheels of the auxiliary undercarriages in dependence of the movement of the auxiliary undercarriages into the selected engagement and the load transmitted by the associated main undercarriages is correspondingly increased and diminished, and a control for each adjustment drive for selective actuation thereof to effectuate the engagement of the wheels under the selected pressure.

2. The self-propelled track working machine of claim 1, further comprising a drive connected to the driven axle and adjustable between different drive modes including a drive mode for moving the machine along the track between working sites and another drive mode for moving the machine along the track at a working site while the track working equipment is in operation, and wherein the control includes a control element responsive to an adjustment of the drive between the drive modes for actuating the adjustment drive.

3. The self-propelled track working machine of claim 2, further comprising means for stopping the drive connected to the driven axle and load gauging means generating an output signal indicating the load on the axles of the undercarriages, the output signal actuating the drive stopping means.

4. The self-propelled track working machine of claim 1, further comprising a spring means mounted to transmit the portion of the load to the dead axle and thence to the track, an abutment plate supporting one end of the spring means, the abutment plate being mounted on the frame transversely glidably substantially in a direction radial to the center point of the associated main undercarriage and the adjustment drive being linked respectively to the dead axle and the abutment plate.

5. The self-propelled track working machine of claim 4, wherein the adjustment drive is arranged to lift the dead axle against the bias of the spring means and in a direction substantially parallel to the path of the spring means bias.

6. The self-propelled track working machine of claim 4 or 5, further comprises bearing means mounted on the dead axle between the wheels thereof for supporting an end of the spring means opposite the one end, the spring means being supported between the abutment plate and the bearing means in a center region of the dead axle, the adjustment drive connected to the dead axle in the region of the bearing means, and the abutment plate including stop means for delimiting the movement of the bearing means and the dead axle relative to the abutment plate.

7. A method of operating a heavy self-propelled track working machine comprising a frame, track working equipment carried by the frame and subjecting the frame to a load, and an undercarriage arrangement which comprises a plurality of main carriages supporting the frame for mobility on the track, each main undercarriage being constituted by a swivel truck having two driven axles each having two wheels engaging the track rails to propel the machine, the load being transmitted from the frame to the track by the axles and wheels of the main undercarriages, and an auxiliary undercarriage associated with each main carriage and arranged adjacent thereto, each auxiliary undercarriage including a dead axle with two wheels arranged to engage the track rails under a selected pressure, which method comprises the steps of propelling the machine selectively in high-speed drive and in low-speed drive, adjusting each auxiliary undercarriage for moving the auxiliary undercarriage for engagement of the wheels of the dead axle with the track rails under the selected pressure in dependence on the drive, and controlling the adjustment movement so as to effectuate the engagement in high-speed drive to transmit portions of the load to the track by the dead axles and correspondingly to decrease the load transmitted to the track by the main undercarriages while effectuating disengagement in low-speed drive and correspondingly to transmit the entire load to the track by the main undercarriages whereby traction is increased.

8. The method of claim 7, wherein the engagement is controlled so as to vary the portions of the load transmitted by the dead axles to hold the load transmitted by the main undercarriages to a predetermined level.

* * * * *